US005273870A

United States Patent [19]

Matejec et al.

[11] Patent Number: 5,273,870

[45] Date of Patent: Dec. 28, 1993

[54] COLOR PHOTOGRAPHIC NEGATIVE RECORDING MATERIAL CONTAINING DIR COMPOUNDS

[75] Inventors: Reinhart Matejec, Leverkusen; Günter Helling, Odenthal, both of Fed. Rep. of Germany

[73] Assignee: Agfa-Gevaert AG, Leverkusen, Fed. Rep. of Germany

[21] Appl. No.: 807,154

[22] Filed: Dec. 13, 1991

[30] Foreign Application Priority Data

Jan. 17, 1991 [DE] Fed. Rep. of Germany ..... 4101179

[51] Int. Cl.[5] ..... G03C 1/46

[52] U.S. Cl. ..... 430/505; 430/504; 430/506; 430/957

[58] Field of Search ..... 430/506, 504, 505, 957

[56] References Cited

U.S. PATENT DOCUMENTS

| | | | |
|---|---|---|---|
| 4,724,197 | 2/1988 | Matejec et al. | 430/505 |
| 4,820,616 | 4/1989 | Matejec et al. | 430/505 |
| 4,963,465 | 10/1990 | Matejec et al. | 430/506 |
| 5,053,324 | 10/1991 | Sasaki | 430/506 |

FOREIGN PATENT DOCUMENTS

| | | |
|---|---|---|
| 1178477 | 11/1984 | Canada . |
| 0062202 | 10/1982 | European Pat. Off. . |
| 0296784 | 12/1988 | European Pat. Off. . |
| 3736048 | 5/1989 | Fed. Rep. of Germany . |

*Primary Examiner*—Charles L. Bowers, Jr.
*Assistant Examiner*—Geraldine Letscher
*Attorney, Agent, or Firm*—Connolly and Hutz

[57] ABSTRACT

Reduced silver halide coverage combined with minimal color granularity and high inter-image effects are obtained with a color photographic negative recording material which, for at least one of the spectral regions blue, green, red, contains a laminate of several component layers containing silver halide and color couplers and consisting of at least one middle component layer B and upper and lower component layers A, A', A'', A''', . . . , the middle component layer B having a sensitivity higher by at least 3 DIN than each of the component layers A, A', A'', A''', . . . , and in which the component layer B contains a DIR compound which is capable of releasing an inhibitor having a diffusibility of not less than 0.4.

10 Claims, No Drawings

COLOR PHOTOGRAPHIC NEGATIVE RECORDING MATERIAL CONTAINING DIR COMPOUNDS

This invention relates to a color photographic negative recording material which comprises at least one photosensitive silver halide emulsion layer containing a color coupler for each of the spectral regions blue, green, red and which, for at least one of the spectral regions blue, green, red, contains a laminate of several component layers containing silver halide and a color coupler and, in at least one of the component layers mentioned, a DIR compound. Through a particular choice and arrangement of the individual component layers in the laminate mentioned and through a particular choice of suitable DIR compounds, more particularly DIR couplers, the invention provides a color photographic negative recording material which, despite a comparatively thin coating of silver halide, provides for good color grain and a high inter-image effect.

To improve color reproduction, modern color photographic recording materials based on silver halide generally contain so-called DIR couplers (DIR development inhibitor releasing). As a result of the inhibiting effect of these DIR couplers during development of the silver halide emulsion layer, gradation in the multilayer material is lower after exposure with white light than after color separation exposure (for example with only red, only green or only blue light). This effect is known in the literature as the inter-image effect (IIE).

The IIE is measured as the percentage steepening of color gradation during color separation exposure with light of the corresponding spectral region in relation to the color gradation established on exposure with white light (T. H. James, The Theory of the Photographic Process, 4th Edition, McMillan Co., New York (1977), pages 574 and 614).

Other advantageous effects of DIR couplers lie in the improved color granularity and in improved sharpness by high so-called edge effects (literature: C. R. Barr, J. R. Thistel, P. W. Vittum: "Development-Inhibitor-Releasing (DIR) Couplers in Color Photography", Phot. Sci. Eng. 13, 74, 214 (1969)).

In general, modern color photographic recording materials also contain not only one silver halide layer, but a plurality of silver halide emulsion layers (component layers) for each of the individual spectral regions blue, green and red (cf. for example DE-C-1 121 470). Such component layers having the same spectral sensitivity may be arranged adjacent one another in the multilayer material in the form of double or multiple layer packets. However, there are also multilayer structures in which individual component layers (separated from one another by separation of filter layers) are alternately arranged (cf. for example DE-A-1 958 709, DE-A-25 30 645; DE-A-26 22 922). DE-A-31 13 009 describes a photographic recording material comprising a laminate of several component layers in which a (component) silver halide emulsion layer of comparatively high sensitivity is enclosed between two color-coupler-containing component layers of comparatively low sensitivity. DIR couplers may also be present both in the more sensitive and in the less sensitive component layers. This material is said to combine relatively high sensitivity with improved sharpness and color grain.

DIR couplers may be present in one or even more silver halide emulsion layers of a color photographic recording material, depending on the particular application envisaged. At least one blue-sensitive layer, at least one green-sensitive layer and at least one red-sensitive layer each best contain a suitable DIR coupler and, where several component layers of different sensitivity are present for one or more of the spectral regions blue, green, red, the DIR coupler is best present in at least one relatively low-sensitivity component layer of a multilayer layer system of substantially the same spectral sensitivity. DIR couplers which are capable of releasing a highly diffusive inhibitor (diffusive development inhibitor releasing compound) may also be used in such a way that they are present in the largest quantity in a component layer of relatively low sensitivity (EP-A-0 318 992). In order to obtain a maximal effect in one regard or the other with a minimal quantity of a DIR coupler, it is favorable to use DIR couplers which release inhibitors of maximal inhibiting strength during development.

The object of the present invention is to provide a color photographic negative recording material which, for predetermined photosensitivity and a predetermined exposure margin, shows minimal color granularity and maximal inter-image effects despite a thin coating of silver halide per square meter.

For ecological reasons, photographic materials are required to have as low a coating of silver halide (A9X) per square meter as possible because layers relatively poor in AgX require less aggressive processing baths, shorter regeneration times and less rinsing.

On the other hand, merely reducing the coverage of silver halide in typical multilayer materials either results in a reduction in photographic sensitivity, a reduction in the exposure margin (expressed by maximal color density and/or gradation) or in an increase in color granularity. In addition, it is difficult to obtain sufficiently high inter-image effects with multilayer materials having a low coverage of silver halide.

Now, the problem addressed by the present invention was to provide a photographic color negative recording material in which the coverage of silver halide can be reduced without any losses in photosensitivity, exposure margin or inter-image effects or any deterioration in color grain.

The present invention relates to a color photographic negative recording material which comprises at least one color-coupler-containing photosensitive silver halide emulsion layer for each of the spectral regions blue, green, red and which, ,for at least one of the spectral regions blue, green, red, contains a laminate of several component layers containing silver halide and color coupler and consisting of at least one middle component layer B and upper and lower component layers A, A', A", A"', . . . , the middle component layer B having a sensitivity higher by at least 3 DIN than each of the component layers A, A', A", A"', . . . , characterized in that the component layer B contains a DIR compound which is capable of releasing an inhibitor having a diffusibility of not less than 0.4.

Accordingly, a laminate consisting of several component layers is present for at least one of the spectral regions blue, green, red and preferably for each of these spectral regions. These laminates have one of the following structures for example:

A/ B/ A'
A/A''/ B/ A'
A/A''/ B/ A'A'''

However, other component layers (A, A'. . . ) of comparatively lower sensitivity may also be present. Similarly, the component layer B of comparatively higher sensitivity may in turn be divided into further component layers. The difference in photosensitivity between component layer B and each of the component layers A, A', A'', A''', . . . is at least 3 DIN and preferably at least 5 DIN.

Within one and the same laminate, the component layers A, A', A'', A''', . . . , where they are photosensitive to any significant extent at all, have the same spectral sensitivity as, or a similar spectral sensitivity to, the component layer B, i.e. the component layers of a laminate are essentially sensitive to light of the same spectral region.

The component layers A, A', A'', A''', . . . , may contain photosensitive silver halide in the same way as the photosensitive component B. However, they may differ from one another in the type and composition of the silver halide. The component layers of a laminate, but at least one or more of them contain color couplers for the chromogenic development of an image dye generally complementary in color to the spectral sensitivity of the laminate.

In addition, in at least one component layer B of comparatively high sensitivity, the recording material according to the invention contains a DIR compound which is capable during development of releasing an inhibitor having a diffusibility $D_f$ of not less than 0.4.

For a definition of diffusibility $D_f$ and a method for its determination, see EP-A-0 115 302.

For the purposes of the present invention, the diffusibility $D_f$ is determined and defined by the following method:

Multilayer test materials A and B were prepared as follows:

Test material A

The following layers are applied in the order indicated to a transparent layer support of cellulose triacetate. All the quantities are based on 1 square meter. For the silver halide applied, the corresponding quantity of $AgNO_3$ is shown. The silver halide emulsions are stabilized with 0.5 g 4-hydroxy-6-methyl-1,3,3a,7-tetraazaindene per 100 g $AgNO_3$. Silver halide emulsion: silver bromide iodide emulsion containing 7 mol-% iodide, mean grain diameter 0.5 μm, cubic crystals with rounded corners.

| | |
|---|---|
| Layer 1 | red-sensitized silver halide emulsion of the above-mentioned type of 4.57 g $AgNO_3$<br>0.754 g cyan coupler K dissolved in<br>0.6 g dibutyl phthalate and dispersed in<br>0.603 g gelatine |
| Layer 2 | unsensitized silver halide emulsion of 2.63 g $AgNO_3$<br>2.63 g $AgNO_3$<br>0.38 g white coupler L<br>1.17 g gelatine |
| Layer 3 | protective layer containing<br>1.33 g gelatine |
| Layer 4 | hardening layer containing<br>0.82 g gelatine<br>0.54 g carbamoyl pyridinium salt (CAS Reg. No 65411-60-1). |

-continued

Cyan coupler K

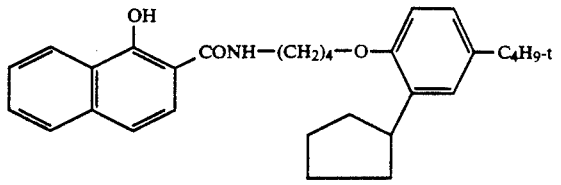

White coupler L

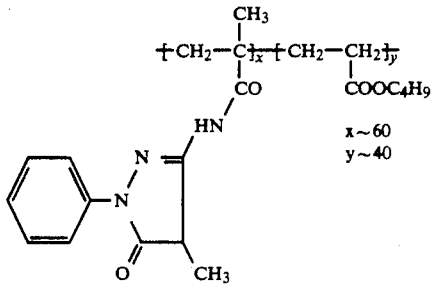

Test material B

A test material B was prepared in the same way as test material A except that layer 2 consisted of 0.346 g white coupler and 0.900 g gelatine.

The test materials A and B are exposed in a dark room for 15 minutes (room lighting, 100 watt bulb at a distance of 1.5 m).

Development is carried out in the same way as described in "The Journal of Photography", 1974, pages 597 and 598, except that the developer was diluted by 20% with water.

Modified developers containing the development inhibitor to be tested are prepared by adding a 0.02 molar solution of the inhibitor in a mixture of methanol and water (8:2), which contains NaOH to a pH value of 9 if necessary for dissolution, to the developer and adding water to give a developer diluted by 20% by volume.

The test materials A and B are developed in the inhibitor-containing (modified) developer and in the inhibitor-free developer and processed in the further steps.

The resulting cyan densities are measured with a densitometer.

The diffusibility $D_f$ is determined in accordance with owing equation:

$$D_f = \frac{(D_{Ao} - D_A/D_{Ao})}{(D_{Bo} - D_B/D_{Bo})}$$

in which $D_{Ao}$ and $D_{Bo}$ represent the color density of the test materials A and B after development in the inhibitor-free developer $D_A$ and $D_B$ represent the color density of the test materials A and B after development in the developer containing the inhibitor in such a concentration that the following equation applies:

$$\frac{D_{Bo} - D_B}{D_B} = 0.5$$
The diffusibility $D_f$, of a number of inhibitors is shown in the following:
| | | $D_f$ |
|---|---|---|
| I-1 | 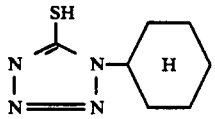 | 0.4 |
| I-2 | 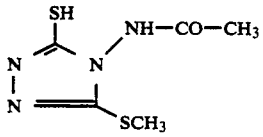 | 0.7 |
| I-3 | 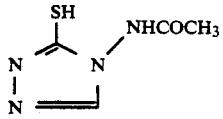 | 0.85 |
| I-4 | 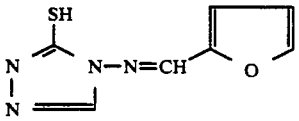 | 0.61 |
| I-5 | 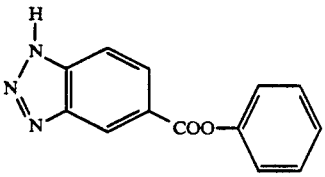 | 0.70 |
| I-6 | 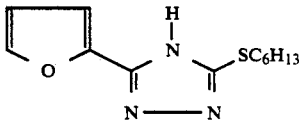 | 0.63 |
| I-7 | 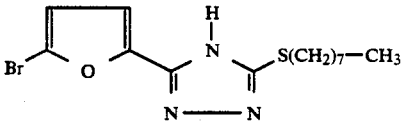 | 0.78 |
| I-8 | 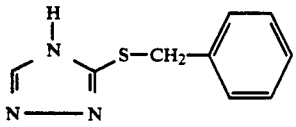 | 0.56 |
| I-9 | 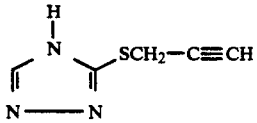 | 0.14 |
| I-10 | 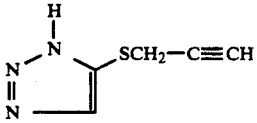 | 0.76 |
-continued
| | | $D_f$ |
|---|---|---|
| I-11 | 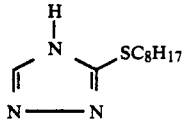 | 0.47 |
| I-12 | 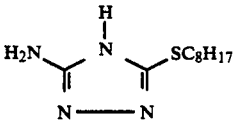 | 0.59 |
| I-13 | 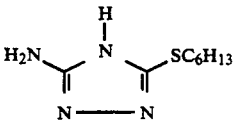 | 0.76 |
| I-14 | 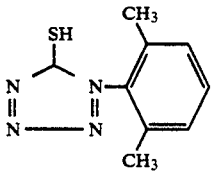 | 0.78 |
| I-15 | 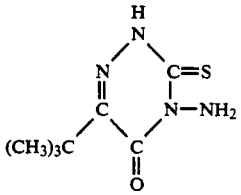 | 0.57 |
| I-16 | 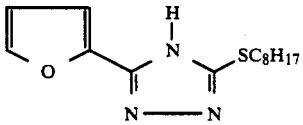 | 0.78 |
| I-17 | 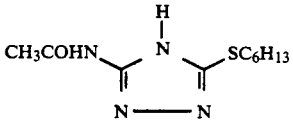 | 0.64 |
| I-18 | 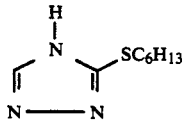 | 0.60 |
| I-19 | 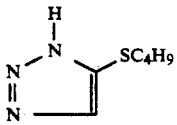 | 0.67 |
| I-20 | 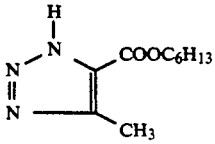 | 0.47 |
The inhibitors are used in the layers of the color photographic recording material in the form of so-called DIR compounds from which they are released imagewise after exposure during the development process and then exert their inhibiting effect, optionally after diffusion into other layers. The DIR compounds are essentially coupling compounds, i.e. compounds which are capable of entering into a coupling reaction with the oxidation products of the color developer used. The inhibitor is then released in consequence of this coupling reaction. The term DIR compound was selected to show that the invention is not limited to the use of DIR couplers which couple to form colored products, but also encompasses compounds which, on reaction with the color developer oxidation products, release inhibitor without at the same time significantly contributing towards the formation of a dye image. Nevertheless, it is preferred to use DIR couplers.

Since it is desired that the inhibitors released intervene in the development process at the earliest possible stage, it is of considerable advantage for the DIR compounds to be highly reactive, i.e. to show a high reaction rate during the reaction with developer oxidation products.

One method of determining coupling reactivity is described in DE-A-27 04 797. According to the invention, preferred DIR compounds have a reactivity k of greater than 5,000 $l \cdot mol^{-1} \cdot s^{-1}$. Examples of suitable DIR compounds are given in the following:

| | | $k[l \cdot mol^{-1} \cdot s^{-1}]$ |
|---|---|---|
| D-1 | 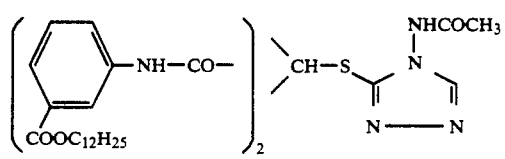 | 12 000 |
| D-2 | 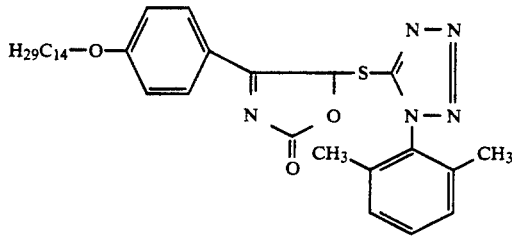 | 10 000 |
| D-3 | 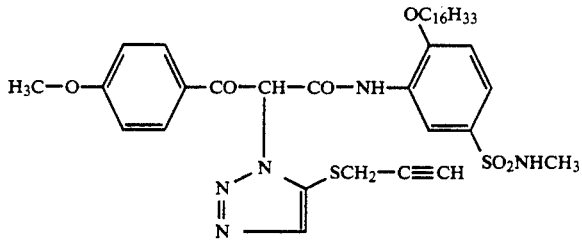 | 10 000 |
| D-4 | 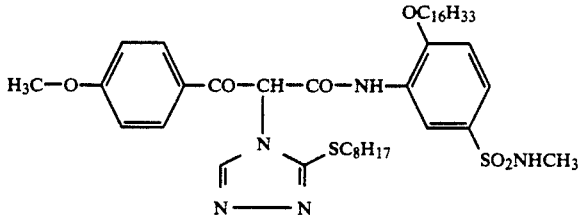 | 15 000 |
| D-5 | 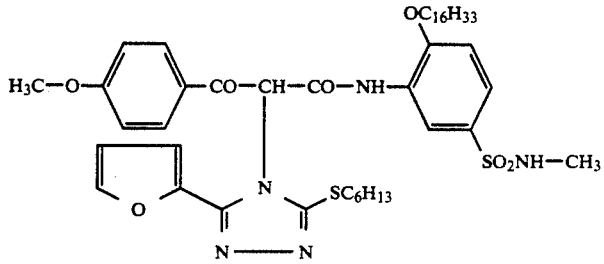 | 13 000 |

-continued
| | | k[l · mol$^{-1}$ · s$^{-1}$] |
|---|---|---|
| D-6 | 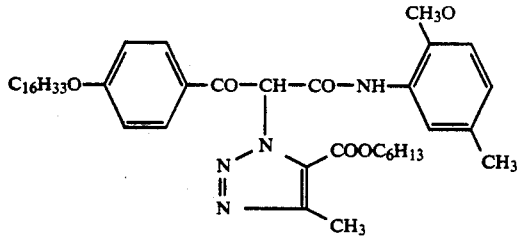 | 18 000 |
| D-7 | 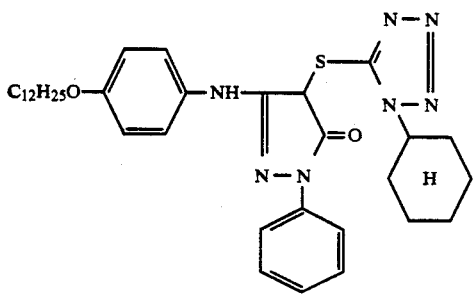 | 12 000 |
| D-8 | 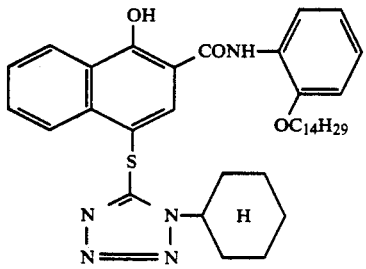 | 10 000 |
| D-9 | 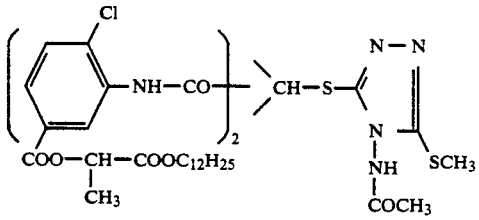 | 11 000 |
| D-10 | 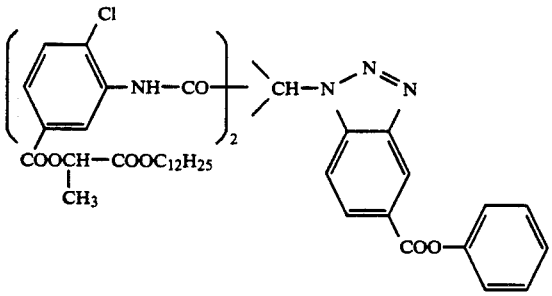 | 15 000 |
| D-11 | 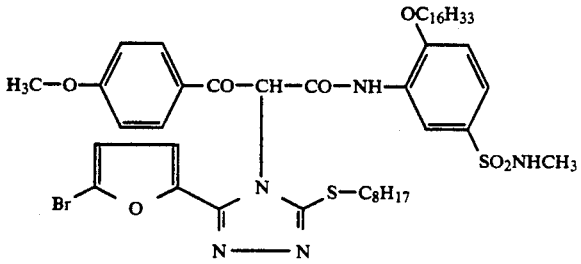 | 13 000 |

-continued
| | | k[l · mol$^{-1}$ · s$^{-1}$] |
|---|---|---|
| D-12 | 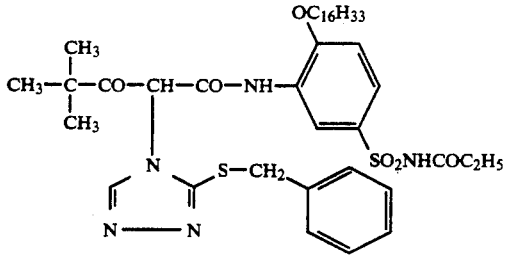 | 25 000 |
| D-13 | 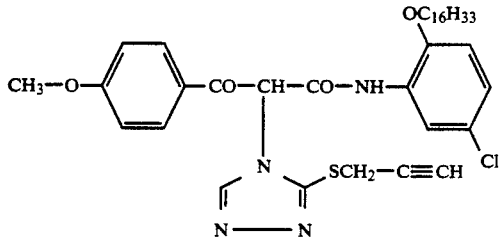 | 10 000 |
| D-14 | 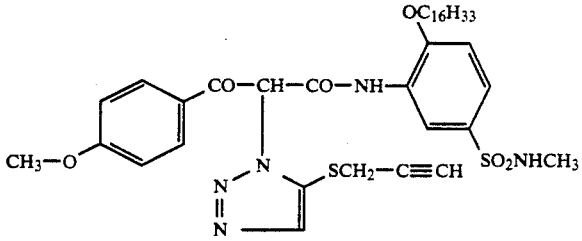 | 10 000 |
| D-15 | 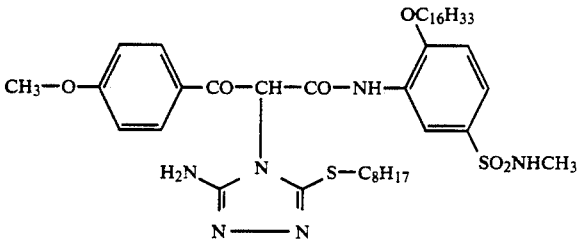 | 14 000 |
| D-16 | 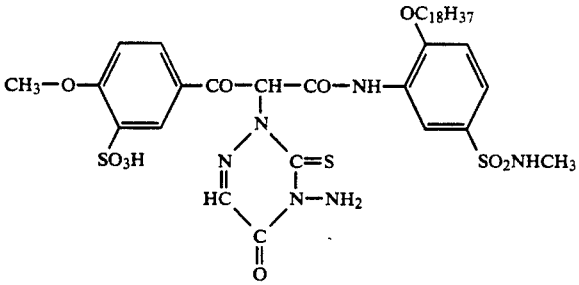 | 11 000 |
| D-17 | 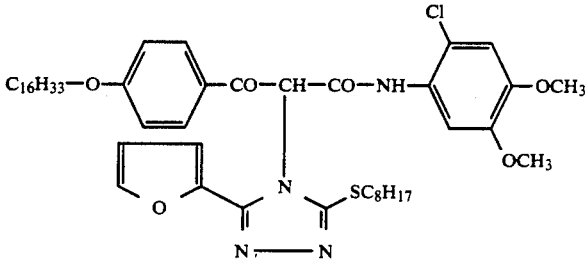 | 10 000 |

-continued

| | | $k[l \cdot mol^{-1} \cdot s^{-1}]$ |
|---|---|---|
| D-18 | 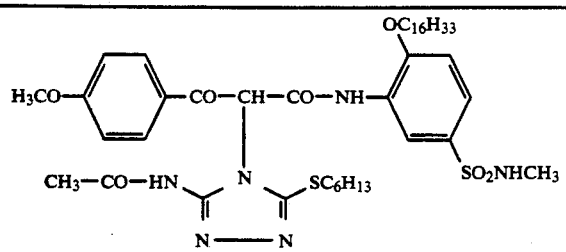 | 10 000 |
| D-19 | 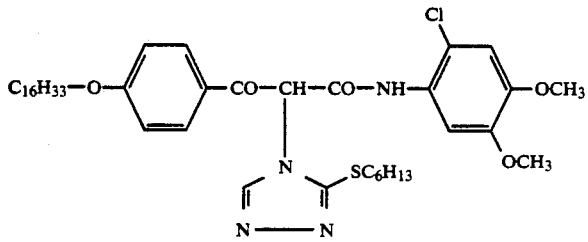 | 8300 |
| D-20 | 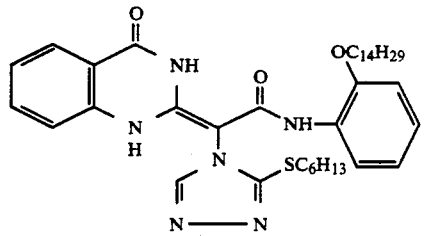 | 7400 |

The component layer B of a laminate according to the invention, in the same way as one, several or all of the component layers A, A', A'', A'''. . . , may additionally contain other DIR compounds, in which the case the diffusibility $D_f$ of the inhibitors released therefrom may even be less than 0.4, depending on the application envisaged.

DIR couplers releasing development inhibitors of the azole type, for example triazoles and benzotriazoles, are described in DE-A-24 14 006, 26 10 546, 26 59 417, 27 54 281, 28 42 063, 36 26 219, 36 30 564, 36 36 824, 36 44 416. Further advantages in regard to color reproduction, i.e. color separation and color purity, and in regard to detail reproduction, i.e. sharpness and granularity, can be obtained with DIR couplers which, for example, do not release the development inhibitor directly as a result of coupling with an oxidized color developer, but only after another subsequent reaction carried out, for example, with a timing group. Examples of this can be found in DE-A-25 55 697, 32 99 671, 38 18 231, 35 18 797, in EP-A-0 157 146 and 0 204 175, in U.S. Pat. Nos. 4,146,396 and 4,438,393 and in GB-A-2,072,363.

DIR couplers releasing a development inhibitor which is decomposed in the developer bath to photographically substantially inactive products are described, for example, in DE-A-32 09 486 and in EP-A-0 167 168 and 0 219 713. This measure provides for uninterrupted development and for constant processing.

Where DIR couplers are used, particularly DIR couplers which release a highly diffusive development inhibitor, improvements in color reproduction, for example more differentiated color reproduction, can be obtained by suitable measures during optical sensitization, as described for example in EP-A-0 115 304, 0 167 173, GB-A-2,165,058, DE-A-37 00 419 and U.S. Pat. No. 4,707,436.

In addition, it has proved to be of advantage if, instead of a low molecular weight color coupler, a polymer coupler or latex coupler is present as color coupler in at least one of the component layers A, A', A'', A''', . . . The component layer B may also contain polymer couplers or latex couplers. Where polymer couplers or latex couplers are used instead of typical low molecular weight couplers, it is possible to obtain distinctly improved image sharpness for the same silver coverage.

High molecular weight color couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284, U.S. Pat. No. 4,080,211, EP-A-0 341 089, U.S. Pat. Nos. 4,612,278 and 4,578,346. The high molecular weight color couplers are generally produced by polymerization of ethylenically unsaturated monomeric color couplers. However, they may also be obtained by polyaddition or polycondensation.

Under suitable reaction conditions, for example where they are produced by emulsion polymerization, the polymer couplers are used in the form of latices (latex couplers) and may be directly added in this form to the casting solutions for the photographic layers.

So-called loaded latices, in which latices are loaded with color couplers, are also suitable for the multilayer materials according to the invention. Loaded latices are described, for example, in DE-OS 2 541 274, DE-A-2 835 856, DE-A-2 820 092, DE-A-2 541 230, DE-A-2 815 635, U.S. Pat. Nos. 4,199,363 and 4,388,403, EP-A-0 069 671, EP-A-0 014 021.

Where latex couplers or latices loaded with couplers are used, it is possible to produce comparatively thin low-binder layers (A, A', A'', A'''. . . ) which has an advantageous effect in terms of a lower thickness of the multilayer material as a whole. In addition, one, several or all of the component layers A, A', A'', A'''. . . of a laminate may be completely free from silver halide. The ratio of coupler to silver halide (in equivalents) is generally greater than 0.2 for the component layers A, A', A'', A'''. . . and hence is greater than the corresponding ratio for the component layer B.

All these measures advantageously work together so that it is possible by means of the invention distinctly to reduce the total silver halide coverage of the recording material without impairing sensitivity and color granularity The recording material preferably has a total silver halide coverage of less than 8.0 g $AgNO_3/m^2$.

Another advantage is that even the intermediate layers or separation layers otherwise normally present between laminates of different spectral sensitivity can be omitted without impairing color separation.

The silver halide present as photosensitive constituent in the photographic material may contain as halide chloride, bromide or iodide or mixtures thereof. For example, 0 to 15 mol-% of the halide component of at least one layer may consist of iodide, 0 to 100 mol-% of chloride and 0 to 100 mol-% of bromide. Silver bromide or silver bromide iodide emulsions, optionally with a small content of silver chloride, are normally used. The silver halide crystals may be predominantly compact crystals which, for example, may have a regular cubic or octahedral shape or transitional shapes. In a preferred embodiment, however, so-called T-grains may be used of which the average diameter-to-thickness ratio (aspect ratio) is preferably at least 5:1, the diameter of a grain being defined as the diameter of a circle having an area corresponding to the protected area of the grain. However, the layers may also contain tabular silver halide crystals in which the diameter-to-thickness ratio is considerably greater than 5:1, for example from 12:1 to 30:1. In a preferred embodiment, at least one of the component layers A, A', A'', A'''. . . and/or the component layer B contains a silver halide T-grain emulsion having an aspect ratio of not less than 7:1. T-grain emulsions are described, for example, in DE-A-32 41 635, DE-A-32 41 647 and U.S. Pat. No. 4,952,491.

In another preferred embodiment, the silver halide grains of at least one of the above-mentioned component layers may even have a multiple-layer grain structure, in the most simple case with an inner and an outer grain zone (core/shell), the halide composition and/or other modifications, such as for example dopings of the individual grain zones, being different. The average grain size of the emulsions is preferably between 0.2 μm and 2.0 μm and the grain size distribution may be both homodisperse and heterodisperse. A homodisperse grain size distribution means that 95% of the grains differ by no more than ±30% from the mean grain size. In addition to the silver halide, the emulsions may also contain organic silver salts, for example silver benztriazolate or silver behenate.

Two or more types of silver halide emulsions prepared separately from one another may be used in the form of a mixture.

Gelatine is preferably used as binder for the photographic layers. However, it may be completely or partly replaced by other natural or synthetic binders.

The emulsions may be chemically and/or spectrally sensitized in the usual way and the emulsion layers and other non-photosensitive layers may be hardened in the usual way with known hardening agents.

Color photographic recording materials normally contain at least one silver halide emulsion layer for recording light of each of the three spectral regions blue, green and red. To this end, the photosensitive layers are spectrally sensitized in known manner by suitable sensitizing dyes. Blue-sensitive silver halide emulsion layers need not necessarily contain a spectral sensitizer because, in many cases, the natural sensitivity of the silver halide (for example silver bromide) is sufficient for recording blue light.

According to the invention, at least one of the silver halide emulsion layers is in the form of a laminate consisting of component layers A, A', A'', A''', . . . B. One such laminate is preferably present for each of the spectral regions blue, green, red.

However, other arrangements are also possible. A non-photosensitive interlayer containing means for suppressing the incorrect diffusion of developer oxidation products is generally arranged between layers of different spectral sensitivity. Where several silver halide emulsion layers of the same spectral sensitivity are present, they may be arranged immediately adjacent one another or in such a way that a photosensitive layer of different spectral sensitivity is present between them (DE-A-1 958 709, DE-A-2 530 654, DE-A-2 622 922).

Each of these laminates contains one or more color couplers for producing the component dye image yellow, magenta or cyan complementary in color to the spectral sensitivity in spatial and spectral association with the photosensitive silver halide contained therein.

By spatial association is meant that the color coupler is present in such a spatial relationship to the silver halide of the same laminate that they are able to interact with one another, allowing imagewise accordance between the silver image formed during development and the dye image produced from the color coupler. This is generally achieved by the presence of the color coupler in the silver halide emulsion layer itself or in an optionally non-photosensitive binder layer adjacent thereto.

By spectral association is meant that the spectral sensitivity of each of the photosensitive silver halide emulsion layers and the color of the component dye image produced from the particular spatially associated color coupler are complementary to one another.

Each of the differently spectrally sensitized laminates may contain one or more color couplers. Where several silver halide emulsion layers of the same spectral sensitivity are present, each of them may contain a color coupler, these color couplers not necessarily having to be the same. They are merely required to produce at least substantially the same color during color development.

Color couplers for producing the cyan component dye image are generally couplers of the phenol or α-naphthol type; preferred cyan couplers correspond to general formulae I and II

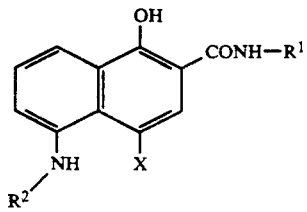

I

-continued

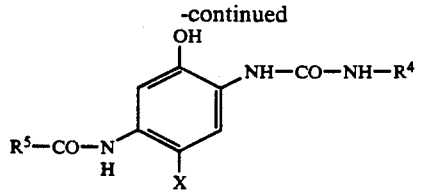

II in which

X is H or a group releasable under the color development conditions which does not provide the coupler with any color;

$R^1$ is alkyl or aryl;

$R^2$ is H, alkyl, aralkyl, acyl, the acyl radical being derived from aliphatic or aromatic carboxylic or sulfonic acids of N-substituted carbamic or sulfinic acids or from carbonic acid semiesters, or $$-\underset{\underset{O}{\|}}{P}(OR^3)_2 \text{ or } -\underset{\underset{O}{\|}}{P}(R^3)_2$$

$R^3$ is alkyl;

$R^4$ is a heterocyclic group or aryl;

$R^5$ is a ballast group; in a preferred embodiment, $R^1$ to $R^5$ may even be parts of a polymer chain.

Cyan couplers corresponding to formula I are described, for example, in EP-A-0 161 626. Cyan couplers corresponding to formula II are described, for example, in EP-A-0 067 689 and in DE-A-39 33 899.

Color couplers for producing the magenta component dye image are generally couplers of the 5-pyrazolone type, the indazolone type or the pyrazoloazole type; preferred magenta couplers correspond to general formulae III, IV and

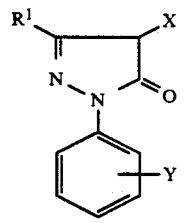

(III)

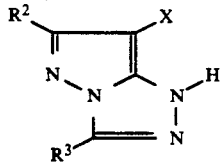

(IV)

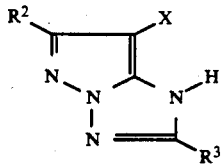

(V)

in which

X is H or a group releasable under the color development conditions;

Y represents one or more substituents, for example Cl, alkoxy, alkylthio, alkylsulfonyl, acylamino;

$R^1$ represents acylamino, optionally containing a ballast group;

$R^2$ and $R^3$ represent H, alkyl, aralkyl, aryl, alkoxy, aroxy, alkylthio, arylthio, amino, anilino, acylamino, cyano, alkoxycarbonyl, carbamoyl, sulfamoyl; these substituents may be further substituted.

In a preferred embodiment, $R^1$ to $R^3$ may even be parts of a polymer chain.

Magenta couplers of this type are described, for example, in U.S. Pat. Nos. 3,725,067 and 4,540,654.

Color couplers for producing the yellow component dye image are generally couplers containing an open-chain ketomethylene group, more particularly couplers of the α-acyl acetamide type, of which suitable examples are α-benzoyl acetanilide couplers and α-pivaloyl acetanilide couplers, preferably those which are attached to polymers.

The color couplers may be 4-equivalent couplers and also 2-equivalent couplers. 2-Equivalent couplers are derived from the 4-equivalent couplers in that they contain in the coupling position a substituent which is eliminated during the coupling reaction. 2-Equivalent couplers include both those which are substantially colorless and also those which have a strong color of their own which either disappears during the color coupling reaction or is replaced by the color of the image dye produced (mask couplers). 2-Equivalent couplers also include couplers which, in the coupling position, contain a releasable group which is released on reaction with color developer oxidation products and develops a certain desired photographic activity either directly or after one or more other groups have been released from the group initially released (for example DE-A-27 03 145, DE-A-28 55 697, DE-A-31 05 026, DE-A-33 19 428).

In addition to the constituents mentioned above, the color photographic recording material according to the invention may contain other additives, such as for example antioxidants, dye stabilizers and agents for influencing the mechanical and electrostatic properties. In order to reduce or avoid the adverse effect of UV light on the dye images produced with the color photographic recording material according to the invention, it is of advantage for example to use UV absorbers in one or more of the layers present in the recording material, preferably in one of the upper layers. Suitable UV absorbers are described, for example, in U.S. Pat. No. 3,253,921, in DE-C-2 036 719 and in EP-A-0 057 160.

The usual layer supports may be used for the materials according to the invention, cf. Research Disclosure No. 17 643, Chapter XVII.

Suitable protective colloids or binders for the layers of the recording material are the usual hydrophilic film formers, for example proteins, particularly gelatine. Casting aids and plasticizers may be used, cf. the compounds mentioned in Research Disclosure No. 17 643, Chapters IX, XI and XII.

The layers of the photographic material may be hardened the usual way, for example with hardeners of the epoxide type, the heterocylic ethylene imine type and the acryloyl type. It is also possible to harden the layers by the process according to DE-A-22 18 009 to obtain color photographic materials suitable for high-temperature processing. The photographic layers may also be hardened with hardeners of the diazine, triazine or 1,2-dihydroquinoline series or with hardeners of the vinyl sulfone type. Other suitable hardeners are known from DE-A-24 39 551, DE-A-22 25 230, DE-A-23 17 672 and from the above-cited Research Disclosure XI.

Other suitable additives can be found in Research Disclosure 17 643 and in "Product Licensing Index", December, 1971, pages 107–110.

To produce color photographic images, the color photographic recording material according to the invention is developed with a color developer compound. Suitable color developer compounds are any developer compounds which are capable of reacting with color couplers in the form of their oxidation product to form azomethine dyes. Suitable color developer compounds are aromatic compounds containing at least one primary amino group of the p-phenylenediamine type, for example N,N-dialkyl-p-phenylenediamines, such as N,N-diethyl-p-phenylenediamine, 1-(N-ethyl-N-methylsulfonamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine.

Other useful color developers are described, for example, in J. Amer. Chem. Soc. 73. 3100 (1951) and in G. Haist, Modern Photographic Processing, 1979, John Wiley and Sons, New York, pages 545 et seq.

After color development, the material is bleached and fixed in the usual way. Bleaching and fixing may be carried out separately or even together with one another. Suitable bleaches are any of the usual compounds, for example $Fe^{3+}$ salts and $Fe^{3+}$ complex salts, such as ferricyanides, dichromates, water-soluble cobalt complexes, etc. particular preference is attributed to iron(III) complexes of aminopolycarboxylic acids, more especially for example ethylenediamine tetraacetic acid, N-hydroxyethyl ethylenediamine triacetic acid, alkyliminodicarboxylic acids and of corresponding phosphonic acids. Persulfates are also suitable bleaches.

EXAMPLE 1

A color photographic recording material for color negative color development was produced (layer combinations 1a to 1c) by application of the following layers in the order indicated to a transparent layer support of cellulose triacetate. The quantities shown are all based on 1 square meter. For the silver halide applied, the corresponding quantities of $AgNO_3$ are shown. All the silver halide emulsions were stabilized with 0.1 g 4-hydroxy-6-methyl-1,3,3a,7-tetraazaindene per 100 g $AgNO_3$.

Wetting agents and other casting aids were added in the usual way. The necessary casting viscosity was adjusted with the polymeric thickening agent VM-1.

| Layer combination 1 a (Invention) | |
|---|---|
| Layer 1 | (antihalo layer) |
| | black colloidal silver sol containing |
| | 0.2 g Ag |
| | 1.2 g gelatine |
| Layer 2 | (red-sensitive layer A) |
| | red-sensitized silver bromide iodide emulsion (3 mol-% iodide; mean grain diameter 0.25 μm) |
| | of 0.25 g $AgNO_3$ containing |
| | 0.60 g gelatine |
| | 0.85 g cyan coupler C-1 |
| Layer 3 | (red-sensitive layer B) |
| | red-sensitized silver bromide iodide (core/shell) emulsion |
| | core: 11 mol-% iodide |
| | mean core diameter: 0.5 μm; |
| | shell: 1.6 mol-% iodide; |
| | mean overall grain diameter 0.85 μm) |
| | of 1.50 g $AgNO_3$ containing |
| | 1.00 g gelatine |

-continued

| Layer combination 1 a (Invention) | |
|---|---|
| | 0.065 g cyan coupler C-2 |
| | 0.035 g DIR coupler DIR-1 |
| | 0.080 g tricresyl phosphate (TCP) |
| Layer 4 | (red-sensitive layer A') |
| | red-sensitized silver bromide iodide emulsion |
| | (3 mol-% iodide; |
| | mean grain diameter 0.25 μm) |
| | of 0.20 g $AgNO_3$ containing |
| | 0.65 g gelatine |
| | 0.70 g cyan cupler C-1 |
| | 0.12 g red mask RM-1 |
| Layer 5 | (green-sensitive layer A) |
| | green-sensitized silver bromide iodide emulsion |
| | (4.5 mol-% iodide; |
| | mean grain diameter 0.24 μm) |
| | or 0.30 g $AgNO_3$ containing |
| | 0.80 g gelatine |
| | 1.40 g magenta coupler M-1 |
| Layer 6 | (green-sensitive layer B) |
| | green-sensitized silver bromide iodide (core/shell) emulsion |
| | core: 8 mol-% iodide, |
| | mean core diameter: 0.45 μm; |
| | shell: 2 mol-% iodide, |
| | mean overall grain diameter 0.82 μm) |
| | of 1.40 g $AgNO_3$ containing |
| | 0.90 g gelatine |
| | 0.05 g yellow mask YM-1 |
| | 0.020 g DIR coupler DIR-1 |
| | 0.08 g TCP |
| Layer 7 | (green-sensitive layer A') |
| | green-sensitized silver bromide iodide emulsion |
| | (4.5 mol-% iodide; |
| | mean grain diameter 0.24 μm) |
| | of 0.20 g $AgNO_3$ containing |
| | 0.50 g gelatine |
| | 0.70 g magenta coupler M-1 |
| | 0.10 g yellow mask YM-1 |
| | 0.10 g TCP |
| Layer 8 | (yellow filter layer) |
| | yellow colloidal silver sol containing |
| | 0.04 g gelatine |
| | 0.15 g 2,5-di-t-pentadecyl hydroquinone |
| | 0.40 g TCP |
| | 0,60 g Polyvinylpyrolidone (PVP) |
| Layer 9 | (blue-sensitive layer A) |
| | blue-sensitized silver bromide iodide emulsion |
| | (4-mol-% iodide; |
| | mean grain diameter 0.27 μm) of |
| | 0.20 g $AgNO_3$ containing |
| | 0.45 g gelatine |
| | 0.65 g yellow coupler Y-1 |
| Layer 10 | (blue-sensitive layer B) |
| | blue-sensitized silver bromide iodide (core/shell) emulsion |
| | core: 12 mol-% iodide |
| | mean core diameter: 0.8 μm; |
| | shell: 7 mol-% iodide, |
| | mean overall grain diameter 1.05 μm |
| | of 1.25 g $AgNO_3$ containing |
| | 0.90 g gelatine |
| | 0.35 g yellow coupler Y-1 |
| | 0.011 g DIR coupler DIR-1 |
| | 0.015 g TCP |
| Layer 11 | (blue-sensitive layer A') |
| | blue-sensitized silver bromide iodide emulsion |
| | (4 mol-% iodide; |
| | mean grain diameter 0.27 μm) |
| | of 0.35 g $AgNO_3$ containing |
| | 1.25 g gelatine |
| | 1.35 g yellow coupler Y-1 |
| Layer 12 | (protective and hardening layer) |
| | of 0.30 g gelatine |
| | 0.50 g hardener H-1 |

Layer combination 1b (Comparison)

As layer combination 1a, but with the following changes:

removal of the DIR couplers from layers B to layers A and A', i.e. layers B (layers 3, 6 and 10) without DIR couplers, instead 17.5 mg DIR-1 in each of layers 2 and 4

10 mg DIR-1 in each of layers 5 and 7

5.5 mg DIR-1 in each of layers 9 and 11 and adaptation of gradation by changing the silver halide coverages in accordance with Table 1 A.

Layer combination 1c (Comparison)

As layer combination 1a, but all layers without DIR couplers and adaptation of gradation by changing the silver halide coverages in accordance with Table 1 A.

TABLE 1A

| | Silver halide coverages (in g $AgNO_3/m^2$) of the layer combinations (1a-1c) | | |
|---|---|---|---|
| Layer | Combination 1a | Combination 1b | Combination 1c |
| 2 | 0.25 | 0.28 | 0.25 |
| 3 | 1.50 | 1.30 | 1.33 |
| 4 | 0.20 | 0.25 | 0.25 |
| 5 | 0.30 | 0.32 | 0.30 |
| 6 | 1.40 | 1.12 | 1.14 |
| 7 | 0.20 | 0.23 | 0.20 |
| 9 | 0.20 | 0.25 | 0.20 |
| 10 | 1.25 | 1.08 | 1.12 |
| 11 | 0.35 | 0.38 | 0.35 |
| Total | 5.65 | 5.21 | 5.14 |

Samples of each of layer combinations la to lc were exposed with white light behind a grey step wedge (exposure time: 0.01 s) and processed by the color negative processing method described in "The British Journal of Photography" (1974), pages 597 and 598.

For exposure to white light, the gradations and maximum color densities (measured over fog) of the three layer combinations 1a to 1c were the same within the limits of experimental error (±2.5%); for photosensitivities, see Table 1B.

The RMS values (=mean variation squares) were determined at different color densities using a 48 μm diameter measuring diaphragm as a measure of the color grain. The method used for this measurement is described in: T. H. James, The Theory of the Photographic Process, 4th Edition, MacMillan Publ. Co., New York (1977), page 619. FIGS. for the measured color grains are also shown in Table 1B.

To determine the inter-image effects, samples of each of layer combinations 1a to 1c were exposed behind a grey step wedge with red light, green light and blue light, respectively. The inter-image effect is the percentage steepening of color gradation during color separation exposure with light of the corresponding spectral region in relation to the color gradation established during exposure with white light (described, for example, in T. H. James, The Theory of the Photographic Process, 4th Edition, McMillan Co., New York (1977), pages 574 and 614).

The inter-image effects of the three layer combinations 1a to 1c are also shown in Table 1B.

It can be seen from Table IB that color grains and inter-image effects show virtually no improvement in relation to the DIR-coupler-free comparison combination 1c through the use of the DIR coupler in component layers A and A (see comparison combination 1b), but are improved by the use of the DIR coupler in layers B of layer combination la according to the invention.

TABLE 1B

| | Layer combination 1a | | | Layer combination 1b | | | Layer combination 1c | | |
|---|---|---|---|---|---|---|---|---|---|
| | Blue | Green | Red | Blue | Green | Red | Blue | Green | Red |
| Photosensitivity [DIN] | 22.5 | 22.3 | 21.8 | 22.6 | 22.5 | 22.0 | 22.9 | 22.5 | 22.1 |
| RMS grain for a density (over fog) of: | | | | | | | | | |
| 0.5 | 13.0 | 11.5 | 9.0 | 21.5 | 18.5 | 17.0 | 22.0 | 19.0 | 17.0 |
| 1.0 | 12.0 | 10.0 | 7.5 | 22.0 | 19.0 | 18.5 | 22.5 | 19.5 | 18.5 |
| 1.5 | 11.5 | 8.5 | 7.0 | 19.5 | 16.5 | 17.0 | 20.5 | 18.0 | 18.5 |
| Inter-image effect for a density of 1.0 (over fog) | 25% | 45% | 42% | 10% | 15% | 15% | 10% | 15% | 15% |

EXAMPLE 2

Layer combination 2a (Invention)

| | |
|---|---|
| Layer 1 | (antihalo layer)<br>as in layer combinations 1a to 1c (of Example 1) |
| Layer 2 | (red-sensitive layer A)<br>red-sensitized silver chloride bromide emulsion<br>(2.5 mol-% chloride and 4.5 mol-% iodide;<br>mean grain diameter 0.18 μm)<br>of 0.15 g $AgNO_3$ containing<br>0.30 g gelatine<br>0.45 g cyan coupler C-3 |
| Layer 3 | (red-sensitive layer A")<br>red-sensitized T grain emulsion having the following characteristic data: |

| | |
|---|---|
| Mean grain size[1)] | 0.66 μm |
| Aspect ratio | 15 |
| Mean diameter[2)] | 0.90 μm |
| Thickness | 0.06 μm |
| % $I^{\ominus}$ | 7 |
| Core[3)] | $AgBr_{0.99}I_{0.01}$ |
| Grain habit | T grain |
| Grain size distribution | Heterodisperse |
| Percentage platelets[4)] | 85 |

[1)]Diameter of the spheres of equal volume
[2)]Diameter of a circle equal in area to the projected area
[3)]Composition in mole fraction
[4)]Percentage platelets in the total projected area of 0.3 g $AgNO_3$, containing 0.28 g gelatine 0.18 g cyan coupler C-4 0.15 g dibutyl phthalate (DBP) 0.08 g TCP

| | |
|---|---|
| Layer 4 | (Red-sensitive layer B) |

| | |
|---|---|
| Mean grain size[1)] | 1.05 μm |
| Aspect ratio | 25 |
| Mean diameter[2)] | 2.7 μm |
| Thickness | 0.11 μm |
| % $I^{\ominus}$ | 7 |
| Core[3)] | $AgBr_{0.99}I_{0.01}$ |
| 1st Zone | $AgBr_{0.8}I_{0.2}$ |
| 2nd Zone | AgBr |
| Grain habit | T grain |
| Grain size distribution | Heterodisperse |
| Percentage platelets[4)] | 70 |

[1)]Diameter of the spheres of equal volume
[2)]Diameter of a circle equal in area to the projected area
[3)]Composition in mole fraction
[4)]Percentage platelets in the total projected area of 1.30 g $AgNO_3$, containing 0.80 g gelatine 0.07 g Cyan coupler C-5 0.06 g -continued DIR coupler DIR 2 0.01 g DIR coupler DIR 3 0.06 g (DBP) 0.03 g TCP

| | |
|---|---|
| Layer 5 | (red-sensitive layer A')<br>red-sensitized silver chloride bromide iodide emulsion<br>(2.5 mol-% chloride and 4.5 mol-% iodide;<br>mean grain diameter 0.18 μm)<br>of 0.20 g $AgNO_3$ containing<br>0.25 g gelatine<br>0.60 g cyan coupler C-3<br>0.15 g red mask RM-2 |
| Layer 6 | (green-sensitive layer A)<br>green-sensitized silver chloride bromide iodide emulsion<br>(2.0 mol-% chloride and 3.5 mol-% iodide;<br>mean grain diameter 0.17 μm)<br>of 0.20 g $AgNO_3$ containing<br>0.65 g gelatine<br>0.60 g magenta coupler M-2 |
| Layer 7 | (green-sensitive layer A")<br>T grain emulsion as in layer 3, but green-sensitized,<br>of 0.25 g $AgNO_3$ containing<br>0.25 g gelatine<br>0.60 g magenta coupler M-2 |
| Layer 8 | (green-sensitive layer B)<br>green-sensitized T grain emulsion having the following characteristic data: |

| | |
|---|---|
| Mean grain size[1)] | 0.98 μm |
| Aspect ratio | 10.5 |
| Mean diameter[2)] | 1.87 μm |
| Thickness | 0.18 μm |
| % $I^{\ominus}$ | 4 |
| Core[3)] | AgBr |
| 1st Zone | $AgBr_{0.88}I_{0.12}$ |
| 2nd Zone | $AgBr_{0.996}I_{0.004}$ |
| 3rd zone | — |
| Grain habit | T grain |
| Grain size distribution | Heterodisperse |
| Percentage platelets[4)] | 70 |

[1)]Diameter of the spheres of equal volume
[2)]Diameter of a circle equal in area to the projected area
[3)]Composition in mole fraction of 1.20 g $AgNO_3$, containing 0.75 g gelatine 0.06 g yellow mark YM-2 0.012 g DIR coupler DIR 4 0.18 g TCP

| | |
|---|---|
| Layer 9 | (green-sensitive layer A')<br>green-sensitized silver chloride bromide iodide emulsion as in layer 6<br>of 0.15 g $AgNO_3$ containing<br>0.48 g gelatine<br>0.45 g magenta coupler M-2<br>0.10 g yellow mask YM-2<br>0.10 g TCP |
| Layer 10 | (yellow filter layer)<br>yellow colloidal silver sol containing<br>0.04 g Ag,<br>0.80 g gelatine<br>0.15 g 2,5-di-t-pentadecyl hydroquinone<br>0.40 g TCP |
| Layer 11 | (blue-sensitive layer A)<br>blue-sensitized silver chloride bromide iodide; emulsion<br>(1.5 mol-% chloride and 3.5 mol-% iodide;<br>mean grain diameter 0.30 μm)<br>of 0.25 g $AgNO_3$ containing<br>0.50 g gelatine<br>0.75 g yellow coupler Y-2 |
| Layer 12 | (blue-sensitive layer B)<br>blue-sensitized silver bromide iodide emulsion<br>(9.0 mol-% iodide;<br>mean grain diameter 1.25 μm)<br>of 1.20 g $AgNO_3$ containing<br>1.00 g gelatine<br>0.40 g yellow coupler Y-3<br>0.009 g DIR coupler DIR-4<br>0.01 g TCP |
| Layer 13 | (blue-sensitive layer A')<br>blue-sensitized silver chloride bromide iodide emulsion as in layer 11<br>of 0.30 g $AgNO_3$ containing<br>0.40 g gelatine<br>0.90 g yellow coupler Y-2 |
| Layer 14 | (protective and hardening layer)<br>0.30 g gelatine<br>0.45 g hardener H-2 |

Layer combination 2b (Comparison)

As layer combination 2a, but with the following changes:

removal of the DIR couplers from layers B to layers A and A", i.e. layers B (layers 4, 8 and 12) with no DIR couplers, instead
2 mg DIR-3 and 4 mg DIR-2 in layer 2
4 mg DIR-3 and 6 mg DIR-2 in layer 3
6 mg DIR-4 in layer 6
6 mg DIR-4 in layer 7
4 mg DIR-4 in layer 11
5 mg DIR-4 in layer 13
and adaptation of gradation by changing the silver halide coverages as shown in Table 2A.

Layer combination 2c (Comparison)

As layer combination 2a, but all layers without DIR couplers and adaptation of gradation by changing the silver halide coverages as shown in Table 2A.

Layer combinations 2a to 2c were processed and evaluated as in Example 1.

The results are shown in Table 2B. It can be seen that, even in Example 2, it is only the use of the DIR coupler in the layers B which clearly improves color grain and the inter-image effect (in layer combination 2a) and not the use of the DIR coupler (in layer combination 2b) in the adjacent layers A and A".

TABLE 2A

| | Silver halide coverages (in g $AgNO_3/m^2$) of the layer combinations (2a to 2c) | | |
|---|---|---|---|
| Layer | Combination 2a | Combination 2b | Combination 2c |
| 2 | 0.15 | 0.18 | 0.16 |
| 3 | 0.30 | 0.35 | 0.32 |
| 4 | 1.30 | 1.15 | 1.17 |
| 5 | 0.20 | 0.22 | 0.20 |
| 6 | 0.20 | 0.22 | 0.22 |
| 7 | 0.25 | 0.30 | 0.26 |
| 8 | 1.20 | 1.04 | 1.04 |
| 9 | 0.15 | 0.18 | 0.16 |
| 11 | 0.25 | 0.29 | 0.27 |
| 12 | 1.20 | 1.03 | 1.04 |
| 13 | 0.30 | 0.37 | 0.32 |
| Total | 5.50 | 5.33 | 5.16 |

TABLE 2B

| | Layer combination 2a | | | Layer combination 2b | | | Layer combination 2c | | |
|---|---|---|---|---|---|---|---|---|---|
| | Blue | Green | Red | Blue | Green | Red | Blue | Green | Red |
| Photosensitivity [DIN] | 26.7 | 26.6 | 26.4 | 26.9 | 26.7 | 26.5 | 27.0 | 26.7 | 26.6 |
| RMS grain for a density | | | | | | | | | |

TABLE 2B-continued

| | Layer combination 2a | | | Layer combination 2b | | | Layer combination 2c | | |
|---|---|---|---|---|---|---|---|---|---|
| | Blue | Green | Red | Blue | Green | Red | Blue | Green | Red |
| (over fog) of: | | | | | | | | | |
| 0.5 | 17.5 | 12.0 | 10.0 | 26.0 | 22.5 | 23.5 | 26.5 | 22.5 | 23.0 |
| 1.0 | 14.5 | 11.0 | 8.5 | 24.0 | 21.0 | 22.0 | 24.0 | 22.0 | 22.5 |
| 1.5 | 14.0 | 9.0 | 8.0 | 23.5 | 20.0 | 21.0 | 24.0 | 21.0 | 22.0 |
| Inter-image effect for a density of 1.0 (over fog) | 20% | 42% | 39% | 8% | 18% | 15% | 8% | 15% | 12% |

EXAMPLE 3

Layer combination 3a (Invention)

Layer 1 (antihalo layer as layer 1 of layer combination 1a) layer 1

Layer 2 (blue-sensitive layer A)
as in layer combination 1a, layer 9, but 0.35 g $AgNO_3/m^2$ Layer 3 (blue-sensitive layer B)
as layer combination 1a, layer 10, but 1.50 g $AgNO_3/m^2$ Layer 4 (blue-sensitive layer A')
as layer combination 1a, layer 11, but 0.15 g $AgNO_3/m^2$ Layer 5 (red-sensitive layer A)
red-sensitized silver chloride bromide emulson
(3.2 mol-% bromide;
mean grain diameter 0.28 μm)
of 0.30 g $AgNO_3$ containing
0.75 g gelatine
0.90 g cyan coupler C-1

Layer 6 (red-sensitive layer B)
red-sensitized silver chloride bromide T grain emulsion
(4.0 mol-% bromide) having the following characteristic data:
mean grain diameter 1.65 μm
thickness 0.18 μm
aspect ratio 9:1
mean sphere equivalents 0.77 μm
of 1.20 g $AgNO_3$ containing
1.20 g gelatine
0.15 g cyan coupler C-1
0.04 g DIR coupler DIR-1
0.03 g TCP Layer 7 (red-sensitive layer A')
red-sensitized silver chloride bromide emulsion
as in layer 5
of 0.15 g $AgNO_3$ containing
0.75 g gelatine
0.95 g cyan coupler C-3
0.15 g red mask RM-1

Layer 8 (green-sensitive layer A)
green-sensitized silver chloride bromide emulsion
(2.6 mol-% bromide;
mean grain diameter 0.24 μm)
of 0.28 g $AgNO_3$ containing
0.65 g gelatine
1.20 g magenta coupler M-1
0.15 g yellow mask YM-1
0.20 g TCP Layer 9 (green-sensitive layer B)
green-sensitized silver chloride iodide T grain emulsion
(2.0 mol-% iodide;
mean grain diameter 1.33 μm)
thickness 0.19
aspect ratio 7:1
mean sphere-equivalent grain size 0.78 μm
of 1.10 g $AgNO_3$ containing
0.80 g gelatine
0.10 g magenta coupler M-3
0.05 g DIR coupler DIR-4
0.02 g TCP Layer 10 (green-sensitive layer A')

-continued

Layer combination 3a (Invention)

green-sensitized silver chloride bromide emulsion
as in layer 8
(2.6 mol-% bromide;
mean grain diameter 0.24 μm)
of 0.10 g $AgNO_3$ containing
0.70 g gelatine
1.40 g magenta coupler M-2

Layer 11 (protective and hardening layer)
as in layer combination 2a, layer 14

Layer combination 3b (Comparison)

As layer combination 3a, but with the following changes:

removal of the DIR couplers from layers B to layers A and A', i.e. layers B (layers 3, 6 and 9) with no DIR couplers, instead
6 mg DIR-1 in each of layers 2 and 4
20 mg DIR-1 in each of layers 5 and 7
25 mg DIR-4 in each of layers 8 and 10 and adaptation of the gradation of the silver halide coverages as shown in Table 3A.

TABLE 3A

| | Silver halide coverages (in g $AgNO_3/m^2$) of the layer combinations (3a to 3c) | | |
|---|---|---|---|
| Layer | Combination 3a | Combination 3b | Combination 3c |
| 2 | 0.35 | 0.38 | 0.36 |
| 3 | 1.50 | 1.40 | 1.43 |
| 4 | 0.15 | 0.20 | 0.15 |
| 5 | 0.30 | 0.35 | 0.30 |
| 6 | 1.20 | 1.15 | 1.18 |
| 7 | 0.15 | 0.20 | 0.16 |
| 8 | 0.28 | 0.30 | 0.28 |
| 9 | 1.10 | 1.00 | 1.04 |
| 10 | 0.10 | 0.12 | 0.10 |
| Total | 5.13 | 5.10 | 5.00 |

Layer combination 3c (Comparison)

As layer combination 3a, but all layers without DIR couplers and adaptation of gradation by changing the silver halide coverages as shown in Table 3A.

Layer combinations 3a to 3c are processed and evaluated as in Example 1.

The results are set out in Table 3B.

It can be seen that, even in Example 3, only the use of the DIR coupler in layers B distinctly improves the color grain and the inter-image effect (in layer combination 3a) whereas, where the DIR coupler is used in layers A and A' (in layer combination 3b), these important parameters in regard to image quality are hardly improved in relation to the DIR-coupler-free layer combination 3c.

In addition, layer combination 3a is distinguished by particularly good image sharpness.

TABLE 3B
| | Layer combination 3a | | | Layer combination 3b | | | Layer combination 3c | | |
|---|---|---|---|---|---|---|---|---|---|
| | Blue | Green | Red | Blue | Green | Red | Blue | Green | Red |
| Photosensitivity [DIN] | 18.6 | 18.4 | 18.2 | 18.9 | 18.5 | 18.4 | 19.0 | 18.6 | 18.5 |
| RMS grain for a density (over fog) of: | | | | | | | | | |
| 0.5 | 16.0 | 10.0 | 10.0 | 24.5 | 22.5 | 22.5 | 24.5 | 23.0 | 22.5 |
| 1.0 | 14.0 | 8.5 | 9.0 | 24.0 | 20.5 | 21.0 | 23.5 | 21.0 | 21.5 |
| 1.5 | 13.5 | 8.0 | 8.0 | 23.5 | 19.0 | 19.0 | 23.0 | 19.5 | 20.0 |
| Inter-image effect for a density of 1.0 (over fog) | 25% | 33% | 35% | 10% | 12% | 15% | 8% | 12% | 14% |
Formulae of the compounds used in layer combination examples 1 to 3:
Cyan coupler C-1
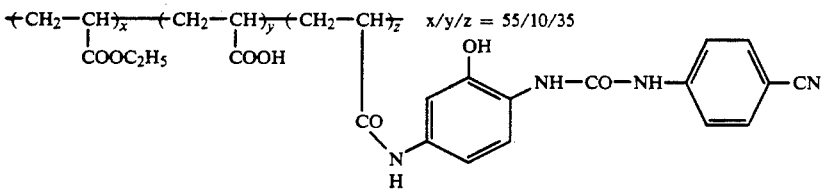
Cyan coupler C-2
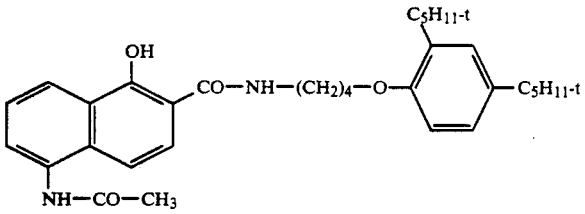
Cyan coupler C-3
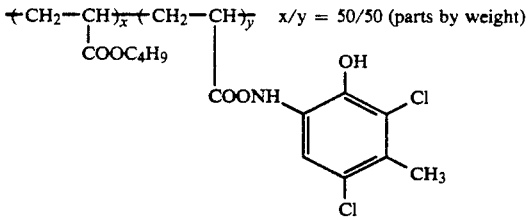
Cyan coupler C-4
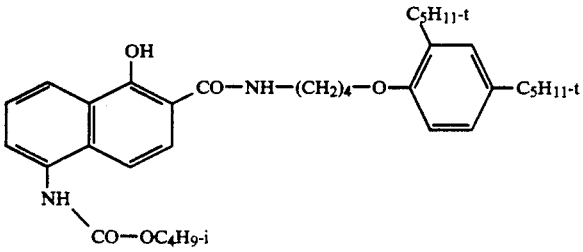
Cyan coupler C-5

-continued
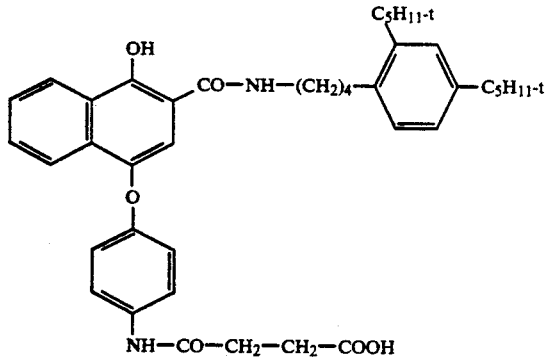
Red mask RM-1
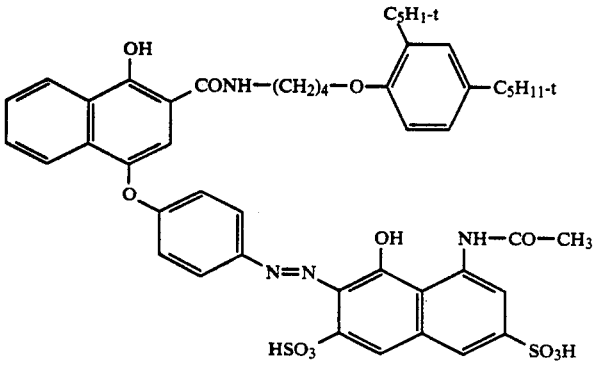
Red mask RM-2
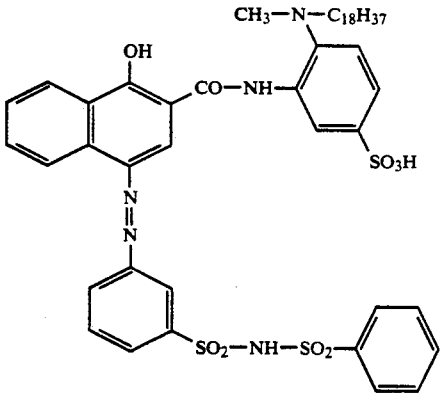
Magenta coupler M-1
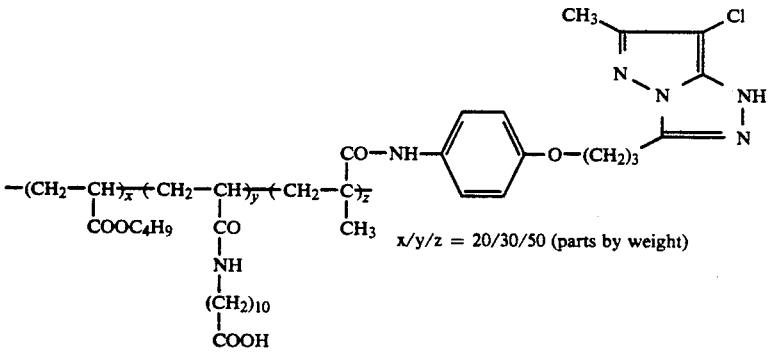
Magenta coupler M-2

-continued
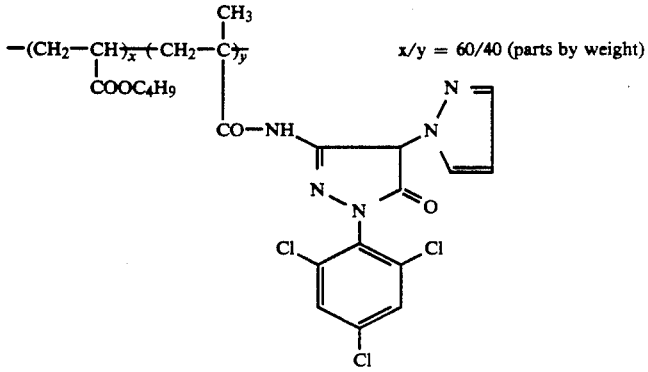
Magenta coupler M-3
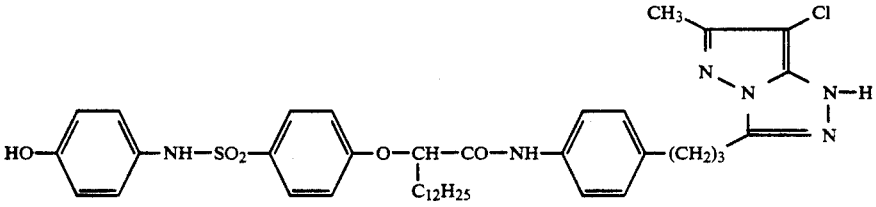
Yellow masks:
Yellow mask YM-1
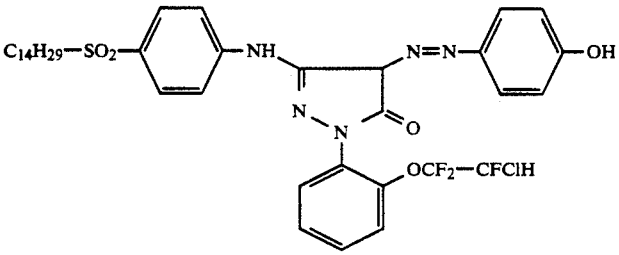
Yellow mask YM-2
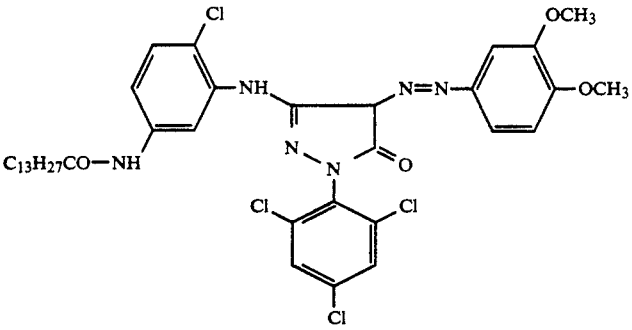
Yellow couplers:
Yellow coupler Y-1
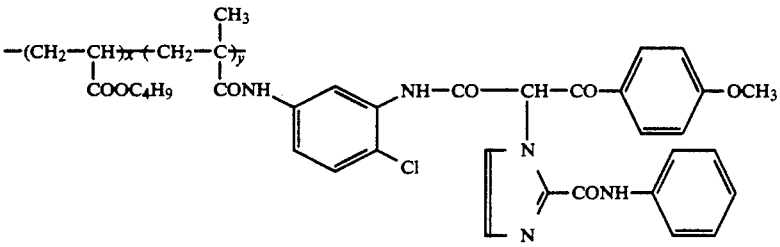
Yellow coupler Y-2

-continued
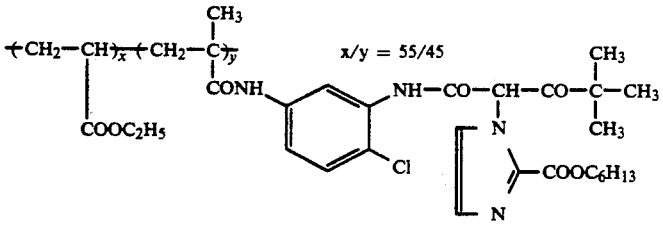
Yellow coupler Y-3
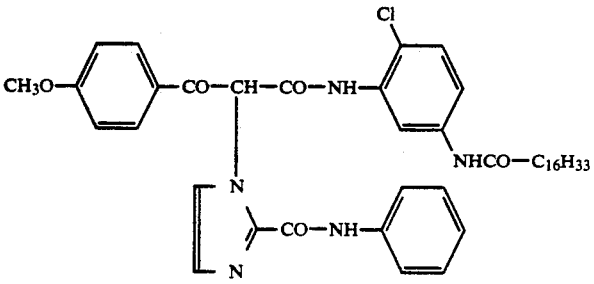
DIR couplers:
DIR-1 ($D_f$ = 0.70)
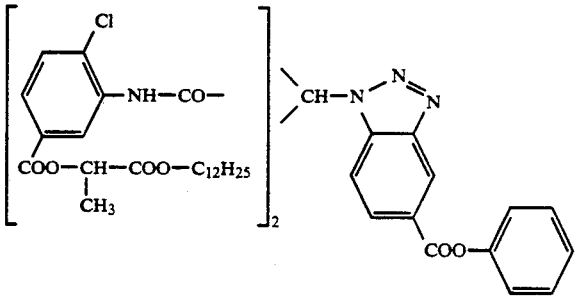
DIR-2 ($D_f$ = 0.18)
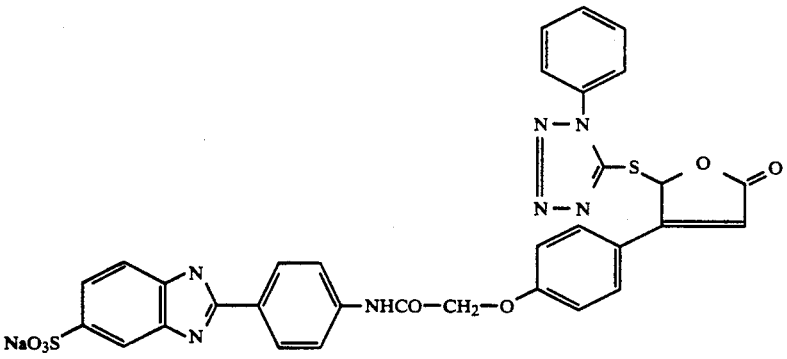
DIR-3 (D = 0.67)
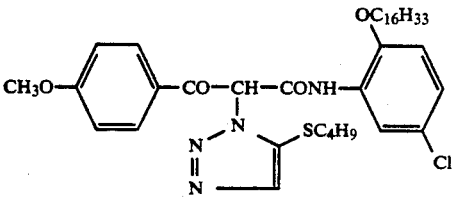
DIR-4 (D = 0.85)

-continued

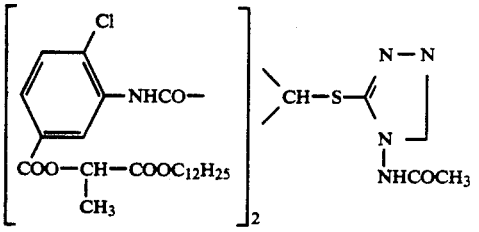

Polymeric thickening agent VM-1

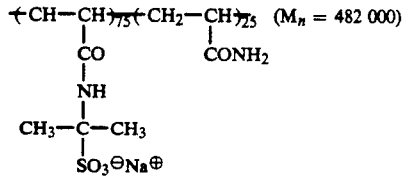

Hardening agents:

Hardening agent H-1

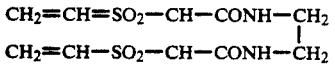

Hardening agent H-2

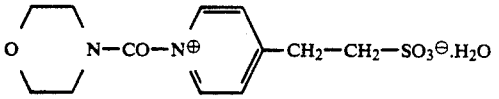

We claim:

1. A color photographic negative recording material which comprises at least one color-coupler-containing photosensitive silver halide emulsion layer for each of the spectral regions blue, green, red and which, for at least one of the spectral regions blue, green, red, contains a laminate of several component layers each of said component layers containing silver halide and a color coupler and each of said component layers of said laminate being sensitive to light of the same spectral region, said laminate consisting of: (i) a middle component layer B having the highest sensitivity of all component layers of said laminate; (ii) a lower component layer A; and (iii) an upper component layer A', wherein: a) said middle component layer B is located between said layer A and said layer A' and is in contact with both said layer A and said layer A'; b) said lower component layer A and said upper component layer A' both have a lower sensitivity than said middle component layer B which has a sensitivity higher by at least 3 DIN than each of the component layers A and A'; and c) said middle component layer B contains a DIR compound which is capable of releasing an inhibitor having a diffusibility of not less than 0.4.

2. A recording material as claimed in claim 1, wherein at least one of the component layers A and A' contains a polymer coupler.

3. A recording material as claimed in claim 1, wherein the total silver halide coverage is not higher than 8.0 g $AgNO_3/m^2$.

4. A recording material as claimed in claim 1, wherein at least one of the component layers of said laminate contains a silver halide emulsion containing tabular silver halide grains with an aspect ratio of at least 7:1.

5. A color photographic negative recording material which comprises at least one color-coupler-containing photosensitive silver halide emulsion layer for each of the spectral regions blue, green red and which, for at least one of the spectral regions blue, green, red contains a laminate of several component layers each of said component layers containing silver halide and a color coupler and each of said component layers of said laminate being sensitive to light of the same spectral region, said laminate consisting of: (i) a middle component layer B having the highest sensitivity of all component layers of said laminate; (ii) at least one lower component layer; and (iii) at least one upper component layer, wherein a) said middle component layer B is located between said at least one upper component layer and said at least one lower component layer and is in contact with a component layer of said at least one upper component layer and a component layer of said at least one lower component layer; b) said middle component layer B has a sensitivity higher by at least 3 DIN than any component layer of said at least one upper component layer and said at least one lower component layer; and c) said middle component layer B contains a DIR compound which is capable of releasing an inhibitor having a diffusibility of not less than 0.4.

6. A color photographic negative recording material which comprises at least one color-coupler-containing photosensitive silver halide emulsion layer for each of the spectral regions blue, green, red and which, for at least one of the spectral regions blue, green, red contains a laminate of several component layers each of said component layers containing silver halide and a color coupler and each of said component layers of said laminate being sensitive to light of the same spectral region, said laminate having the following structure:

$$A/A''/[\ldots/A^x/]B/A'/A'''[/\ldots]A^y]$$

wherein each slash (/) represents an interface between two component layers and further wherein middle component layer B: (as) has a sensitivity higher by at least 3

DIN than any other component layer in said laminate; (b) contains a DIR compound which is capable of releasing an inhibitor having a diffusibility of not less than 0.4; and (c) is in direct contact with both lower component layer A'' and upper component layer A'.

7. A recording material as claimed in claim 5, wherein at least one component layer of said at least one upper component layer or said at least one lower component layer contains a polymer coupler.

8. A recording material as claimed in claim 5, wherein at least one component layer of said at least one upper component layer and at least one component layer of said at least one lower component layer contain a polymer coupler.

9. A recording material as claimed in claim 5, wherein the total silver halide coverage is not higher than 8.0 g $AgNO_3/m^2$.

10. A recording material as claimed in claim 5, wherein at least one of the component layers of said laminate contains a silver halide emulsion containing tabular silver halide grains with an aspect ratio of at least 7:1.

* * * * *